US006089977A

United States Patent [19]

Bennett

[11] Patent Number: 6,089,977

[45] Date of Patent: Jul. 18, 2000

[54] SLOT MACHINE GAME WITH ROAMING WILD CARD

[76] Inventor: Nicholas Luke Bennett, 28 Quinlan Pde., Manly Vale, N.S.W., 2093, Australia

[21] Appl. No.: 09/125,930

[22] PCT Filed: Feb. 28, 1997

[86] PCT No.: PCT/AU97/00121

§ 371 Date: Aug. 27, 1998

§ 102(e) Date: Aug. 27, 1998

[87] PCT Pub. No.: WO97/32285

PCT Pub. Date: Sep. 4, 1997

[30] Foreign Application Priority Data

Feb. 28, 1996 [AU] Australia ..... PN 8362

[51] Int. Cl.[7] ..... G07F 17/34

[52] U.S. Cl. ..... 463/20; 463/13; 273/143 R

[58] Field of Search ..... 463/9, 12, 13, 463/16, 20; 273/143 R, 138.2, 138 A, 138.1

[56] References Cited

U.S. PATENT DOCUMENTS

| | | | |
|---|---|---|---|
| 5,332,228 | 7/1994 | Schultz | 463/13 |
| 5,449,173 | 9/1995 | Thomas et al. | 273/143 R |
| 5,772,506 | 6/1998 | Marks et al. | 463/13 |

FOREIGN PATENT DOCUMENTS

| | | |
|---|---|---|
| 5942096 | 7/1996 | Australia . |
| 0238289 | 3/1987 | European Pat. Off. . |
| 9314462 | 12/1992 | WIPO . |

*Primary Examiner*—Benjamin H. Layno
*Attorney, Agent, or Firm*—Friedman Siegelbaum, LLP

[57] ABSTRACT

A slot machine 40, of the type having a video display screen which displays a plurality of rotatable reels 42 carrying symbols 43, is arranged to pay a prize on the occurrence of a predetermined symbol or combination of symbols. The game includes a special feature which is invoked when a special triggering combination of symbols occurs. Once the special feature is triggered a wild symbol moves around the screen progressively replacing each symbol in the display.

14 Claims, 3 Drawing Sheets

SLOT MACHINE GAME WITH ROAMING WILD CARD

INTRODUCTION

The present invention relates to gaming machines of the type arranged to play a game of poker and in particular the invention provides an improvement to a game played on such a machine.

Players who regularly play gaming machines quickly tire of particular games and therefore it is necessary for manufacturers of these machines to come up with innovative game features that add interest to the games provided on such machines in order to keep the players amused and therefore willing to continue playing the game.

DESCRIPTION OF THE PRIOR ART

Gaming or poker machines have been well known in the state of New South Wales for many years and have more recently gained considerable popularity throughout Australia, with quite substantial amounts of money wagered on these machines. There is a growing tendency for State Governments to legalise the use of gaming machines by licensing operators, with resulting revenue gains through licence fees and taxation of monies invested. The licensed operation of gaming machines is the subject of State legislation and regulation. This regulation most always dictates a maximum percentage payout for a gaming machine. For example, a maximum of 85% of monies invested must be returned as winnings, and manufacturers of gaming machines therefore must design their machines around these regulatory controls.

With the growth that has occurred in the gaming machine market there is intense competition between manufacturers to supply the various existing and new venues. When selecting a supplier of gaming machines, the operator of a venue will often pay close attention to the popularity of various games with their patrons. Therefore, gaming machine manufacturers are keen to devise games which are popular with players, as a mechanism for improving sales.

Many various strategies have been tried in the past to make games more enticing to players, including the commonly known double-up feature, whereby, if a player wins a particular game, they can then risk the winnings of that game in a double-or-nothing mode in which they gamble on a subsequent, and often different, game such as whether a red or black card will be the next card drawn.

Other techniques adopted in the past have been to provide complexity in the numbering and combinations of indicia which would result in a win, thereby hoping to convince the player that there is a greater chance of winning and to keep their interest in a particular game.

The present invention provides a game feature in which in response to a trigger condition a wild card symbol roams around the display and a prize is awarded for winning combinations created while the wild card is positioned at each location.

SUMMARY OF THE INVENTION

The present invention consists in a gaming machine having display means, and game control means arranged to control images displayed on the display means, the game control means being arranged to play a game wherein a plurality of symbols are randomly selected and displayed on the display means and, if a winning combination results, the machine pays a prize, the game being characterised in that upon the occurrence of a predetermined triggering event, a wild card symbol is displayed in a first display location and then progressively moved to each of a predetermined number of other display locations, a prize being awarded for winning combinations formed with the wild card symbol for each location in which the wild card symbol is displayed.

The present invention is applicable to video gaming machines of the traditional poker machine style (also known as slot machines or fruit machines) in which the display means comprises a video simulation of a set of rotatable reels, each carrying a plurality of symbols. The invention is equally applicable to video draw poker machines in which a poker hand is displayed on the screen, the cards of the hand being selected from a standard 52 or 53 card deck.

Preferably, the feature of the present invention will be triggered by the occurrence of a special symbol or a combination of special symbols displayed in a particular arrangement. In the preferred embodiment the feature is triggered by a first symbol, preferably an iceberg, appearing in the first (or left hand) column of the display and a second symbol preferably a symbol having a coin background appearing in the last (or right hand) column of the display.

In the preferred embodiment the wild card symbol is a penguin and this symbol is moved from one location to another via an animated walking motion. Preferably, the wild card symbol is first displayed at a location at one end of the display and is progressively moved from location to adjacent location until it has been displayed in each and every location of the display.

BRIEF DESCRIPTION OF THE DRAWINGS

An embodiment of the invention will now be described, by way of example with reference to the accompanying drawings, in which.

DETAILED DESCRIPTION OF THE PREFERRED EMBODIMENTS

In the following detailed description the methodology of the embodiments will be described, and it is to be understood that it is within the capabilities of the non-inventive worker in the art to introduce the methodology on any standard microprocessor-based gaming machine by means of appropriate programming.

Figure 1:
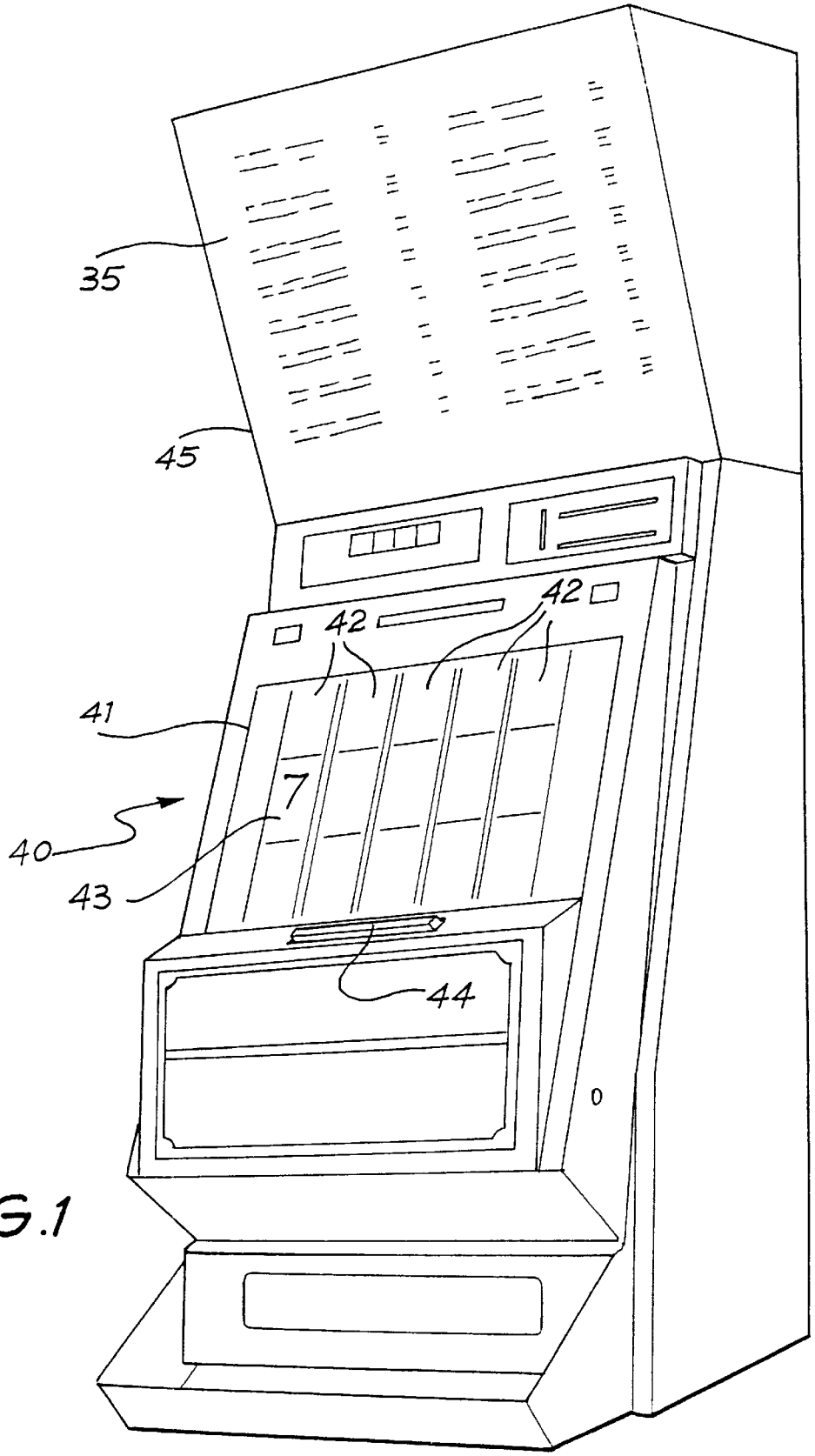
FIG. 1 illustrates a gaming machine with a video simulation of a rotating reel display incorporating a first embodiment of the invention.
Figure 2:
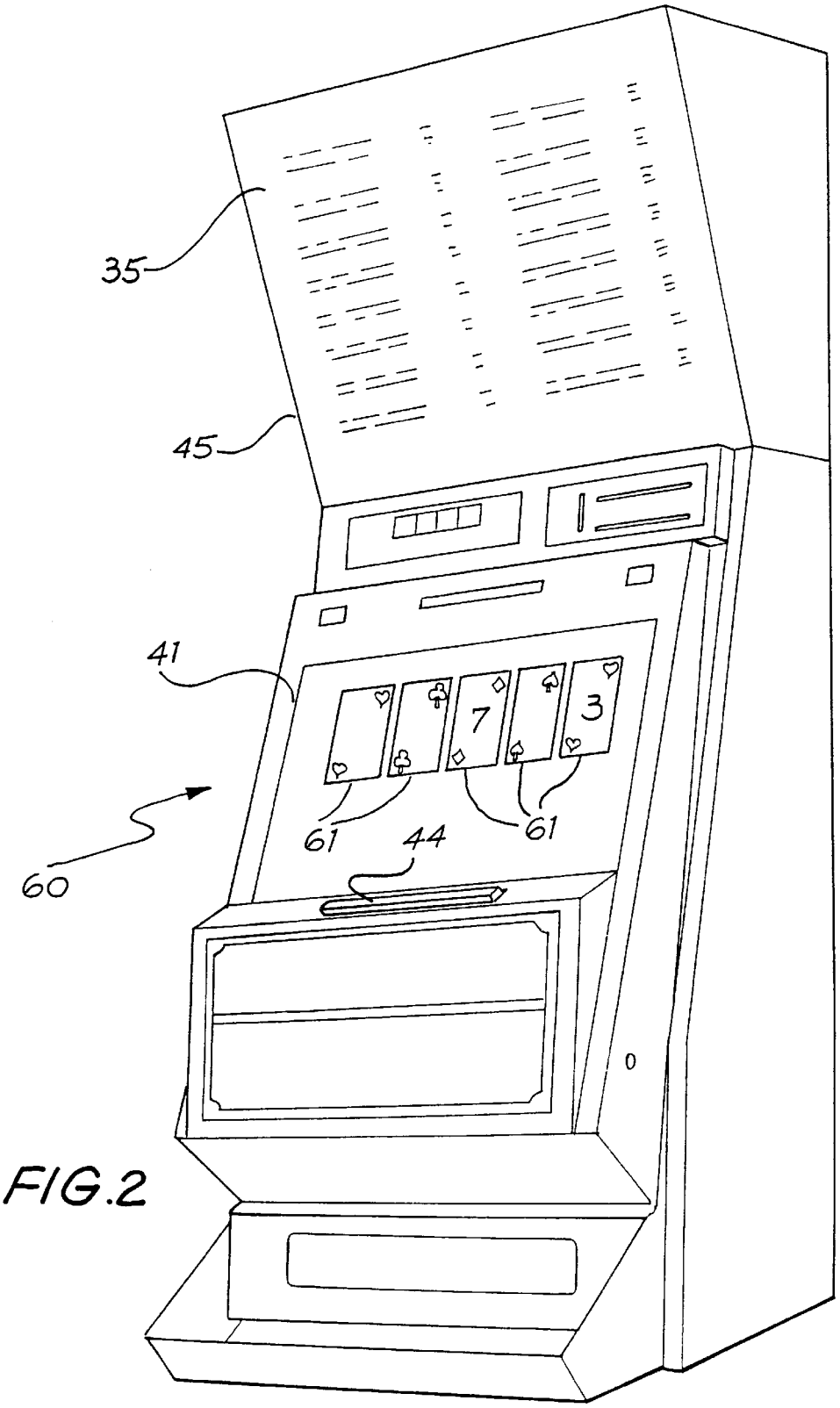
FIG. 2 illustrates a video draw poker machine incorporating a second embodiment of the invention.

Referring to FIG. 1 of the drawings, the first embodiment of the invention is illustrated in which a slot machine 40, of the type having a video display screen which displays a plurality of rotatable reels 42 carrying symbols 43, is arranged to pay a prize on the occurrence of a predetermined symbol or combination of symbols.

In the slot machine 40 illustrated in FIG. 1, the game is initiated by a push button 44, however, it will be recognised by persons skilled in the art that this operating mechanism might be replaced by a pull handle or other type of actuator in other embodiments of the invention. The top box 45 on top of the slot machine 40 carries the artwork panel 35 which displays the various winning combinations for which a prize is paid on this machine.

The game played on this machine is a relatively standard game which includes a 3 by 5 symbol display and allows multiple pay lines. The game also includes a special feature embodying the invention, the special feature being invoked when an iceberg symbol appears in the left hand column and a background coin symbol appears in the right hand column of the display. The background coin symbol as used in this game comprises any standard symbol of the game superimposed over a background image of a coin.

In the following description of the feature embodying the invention, game symbols will be abbreviated as listed below:

| | |
|---|---|
| Penguin | PENGUIN |
| Iceberg | ICE |
| Polarbear | PO |
| Seal | SE |
| Dog | DOG |
| Whale | WH |
| King | K |
| Queen | Q |
| Jack | J |
| Background coin | -/B (- = any other symbol except Iceberg and Penguin) |

When the feature is invoked, a special PENGUIN sound associated with the feature is heard and an animated PENGUIN symbol and sounds are to accompany the animation. At each win during the feature, normal winning tunes are to be heard as the win meter increments in the same manner as for the base game to which the feature has been added. These tunes last for the length of time that the win meter is incrementing.

The sequence of the features in this embodiment are as follows:

1. When an ICEBERG appears anywhere on Reel 1 together with a background COIN anywhere on Reel 5, the PENGUIN FEATURE begins.
2. The number of lines and the credits bet per line played before the feature starts is the same for the feature.
3. When the feature begins, feature PENGUIN SOUNDS will occur and a message centred in the display area above the symbols "PENGUIN FEATURE" is to be displayed.
4. The animated PENGUIN symbol will appear on the screen, on top of the top left hand symbol on Reel 1.
5. The PENGUIN will move to each symbol in the window (Animation from Video Graphics). As the PENGUIN moves to each of the symbols the symbol changes to a PENGUIN then changes back to the original symbol as the PENGUIN moves on to the next symbol and pays each winning combination in which the PENGUIN substitutes. For each paying combination the PENGUIN animation will be extended (that is, a PENGUIN dancing and moving its arms as the meter increments. (See examples). The win meter increment speed for each partial feature pay will be "as if" the win meter started at zero.

Example

| | | | | |
|---|---|---|---|---|
| ICE | K | J | DOG | WH |
| PO | Q | PO | PO | PO |
| SE | J | Q | WH | J/B |

A combination of an ICEBERG displayed on the first reel, and a Jack with background coin on the last reel starts the feature.

| | | | | |
|---|---|---|---|---|
| PENGUIN | K | J | DOG | WH |
| PO | Q | PO | PO | PO |
| SE | J | Q | WH | J/B |

When the feature begins the Penguin appears on the top symbol on Reel 1.

| | | | | |
|---|---|---|---|---|
| ICE | K | J | DOG | WH |
| PENGUIN | Q | PO | PO | PO |
| SE | J | Q | WH | J/B |

The Penguin then moves to the second position and the top symbol changes back to the original symbol.

| | | | | |
|---|---|---|---|---|
| ICE | K | J | DOG | WH |
| PO | Q | PO | PO | PO |
| PENGUIN | J | Q | WH | J/B |

The Penguin moves to the third position and the second symbol changes back to its original symbol.

| | | | | |
|---|---|---|---|---|
| ICE | K | J | DOG | SE |
| PO | Q | PO | PO | PO |
| SE | PENGUIN | Q | SE | J/B |

Figure 3:
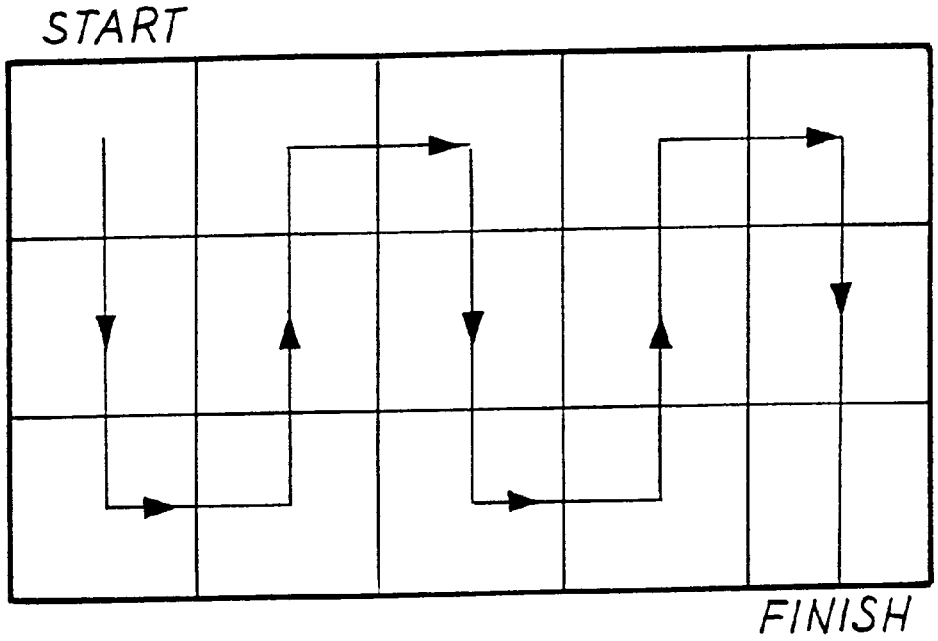
FIG. 3 diagrammatically illustrates a wild card symbol display progression path for the embodiment of FIG. 1.

The Penguin then moves on to the fourth position and the third symbol changes back to its original symbol and so on. The path followed by the PENGUIN is illustrated diagrammatically in FIG. 3.

6. As the PENGUIN moves from symbol to symbol, sounds of a PENGUIN WALKING will be heard.
7. At each win during the feature, a 'win' sound, as in the base game, will be heard as the win meter increments. Sounds are to last for the length of time as win meter increments.
8. When the PENGUIN reaches the last position in the window, the PENGUIN disappears and a message displaying "END OF PENGUIN FEATURE" is to be centred in the display area above the symbols.

Example: Playing 9 lines: All pays each way:

Of the 15 positions the PENGUIN walks to, this example shows just some of the winning combinations.

| | | | | |
|---|---|---|---|---|
| ICE | Q | J | DOG | WH |
| SE | SE | SE | PO | PO |
| K | J | WH | WH | J/B |

This combination starts the feature and pays 3 of a kind SEAL, 2 of a kind POLAR and 3 of a kind scattered WHALE.

| | | | | |
|---|---|---|---|---|
| ICE | Q | J | DOG | WH |
| PENGUIN | SE | SE | PO | PO |
| K | J | WH | WH | J/B |

The PENGUIN moves to the second position of the walk and pays the 3 of a kind SEAL only.

| | | | | |
|---|---|---|---|---|
| ICE | Q | J | DOG | WH |
| SE | PENQUIN | SE | PO | PO |
| K | J | WH | WH | J/B |

When the PENGUIN reaches the second column, on the centre line it pays 3 of a kind SEAL and 2 of a kind POLAR.

| | | | | |
|---|---|---|---|---|
| ICE | Q | PENGUIN | DOG | WH |
| SE | SE | SE | PO | PO |
| K | J | WH | WH | J/B |

When the PENGUIN reaches this position it will pay 3 of a kind QUEEN.

| | | | | |
|---|---|---|---|---|
| ICE | Q | J | DOG | WH |
| SE | SE | PENGUIN | PO | PO |
| K | J | WH | WH | J/B |

When the PENGUIN reaches this position it will pay 3 of a kind SEAL, 2 of a kind POLAR and 3 of a kind QUEEN.

| | | | | |
|---|---|---|---|---|
| ICE | Q | J | DOG | WH |
| SE | SE | SE | PENGUIN | PO |
| K | J | WH | WH | J/B |

When the PENGUIN reaches this position it will pay 4 of a kind SEAL and 2 of a kind POLAR and 3 of a kind JACK.

| | | | | |
|---|---|---|---|---|
| ICE | Q | J | DOG | WH |
| SE | SE | SE | PO | PENGUIN |
| K | J | WH | WH | J/B |

When the PENGUIN reaches this position it will pay 2 of a kind POLAR.

When applied to a draw poker machine, the feature might be invoked, for example by an ACE in the first card position and a club suit in the last card position.

The special feature symbol (equivalent to the PENGUIN in the previous embodiment) would then be displayed sequentially in each card position and act as a wild card in combination with the remaining cards of the hand. A prize is awarded for each new winning combination created by the wild card.

The slot machine 60 of claim 2, is similar to that of FIG. 1 in all respects except that instead of pseudo spinning reels 42 carrying symbols 43, the video display 41 displays a hand of a card game comprising, for example, 5 cards 61 of a draw poker hand.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A gaming machine having display means, and game control means arranged to control images displayed on the display means, the game control means being arranged to play a game wherein a plurality of symbols are randomly selected and displayed on the display means and, if a winning combination results, the machine awards a prize, the game being characterised in that, if a predetermined triggering event occurs, a wild card symbol is displayed in a first display location of the displayed plurality of randomly selected symbols and is then progressively moved to each of a predetermined number of other display locations before the next randomly selected symbols are displayed, a prize being awarded for winning combinations formed with the wild card symbol for each location in which the wild card symbol is displayed.

2. The gaming machine of claim 1 wherein the display means comprises a video display simulating a set of rotatable reels, each carrying a plurality of symbols.

3. The gaming machine as claimed in claim 2, wherein the triggering event is the occurrence of a special symbol or a combination of special symbols displayed in a particular arrangement.

4. The gaming machine of claim 3 wherein the triggering event is the occurrence of a first symbol, appearing in the first (or left hand) column of the display and a second symbol appearing in the last (or right hand) column of the display.

5. The gaming machine of claim 4 wherein the first symbol is an iceberg and the second symbol is a symbol having a coin background.

6. The gaming machine as claimed in claim 2, wherein the wild card symbol is a penguin and this symbol is moved from one location to another via an animated walking motion.

7. The gaming machine as claimed in claim 2, wherein the wild card symbol is first displayed at a location at one end of the display and is progressively moved from location to adjacent location until it has been displayed in each and every location of the display.

8. The gaming machine of claim 1 wherein the display means is a video display arranged to display the cards of the hand being selected from a standard 52 or 53 card deck.

9. The gaming machine of claim 1, wherein the display means is a video display arranged to display the cards of the hand being selected from a standard 52 or 53 card deck.

10. The gaming machine as claimed in claim 9, wherein the triggering event is the occurrence of a special symbol or a combination of special symbols displayed in a particular arrangement.

11. The gaming machine of claim 10, wherein the triggering event is the occurrence of a first symbol, appearing in the first (or left hand) column of the display and a second symbol appearing in the last (or right hand) column of the display.

12. The gaming machine of claim 11, wherein the first symbol is an iceberg and the second symbol is a symbol having a coin background.

13. The gaming machine as claimed in claim 9, wherein the wild card symbol is a penguin and this symbol is moved from one location to another via an animated walking motion.

14. The gaming machine as claimed in claim 9, wherein the wild card symbol is first displayed at a location at one end of the display and is progressively moved from location to adjacent location until it has been displayed in each and every location of the display.

* * * * *